US008844836B2

(12) United States Patent
Krieg

(10) Patent No.: US 8,844,836 B2
(45) Date of Patent: Sep. 30, 2014

(54) RAIL CLAMP FOR ATTACHING A RAIL AND SYSTEM PROVIDED WITH A RAIL CLAMP OF THIS TYPE

(75) Inventor: Nikolaj Krieg, Hagen (DE)

(73) Assignee: Vossloh-Werke GmbH, Werdohl (DE)

( * ) Notice: Subject to any disclaimer, the term of this patent is extended or adjusted under 35 U.S.C. 154(b) by 292 days.

(21) Appl. No.: 12/939,831

(22) Filed: Nov. 4, 2010

(65) Prior Publication Data

US 2012/0111959 A1 May 10, 2012

(51) Int. Cl.
*E01B 9/30* (2006.01)

(52) U.S. Cl.
CPC ..... *E01B 9/303* (2013.01)
USPC ..... 238/349; 238/351

(58) Field of Classification Search
USPC ..... 238/310, 315, 338, 349, 351, 352
See application file for complete search history.

(56) References Cited

U.S. PATENT DOCUMENTS

| | | | | |
|---|---|---|---|---|
| 3,439,874 A | | 4/1969 | Meier | |
| 3,690,551 A | | 9/1972 | Munch | |
| 4,312,478 A | * | 1/1982 | Matsuo et al. | 238/349 |
| 4,632,307 A | * | 12/1986 | Weber | 238/265 |
| 4,705,215 A | * | 11/1987 | Eisenberg et al. | 238/349 |
| 4,907,740 A | * | 3/1990 | Oberweiler et al. | 238/283 |
| 5,096,119 A | * | 3/1992 | Schultheiss et al. | 238/349 |
| 2008/0105758 A1 | * | 5/2008 | Schwiede et al. | 238/349 |
| 2008/0237363 A1 | * | 10/2008 | Hauschild et al. | 238/349 |
| 2009/0084864 A1 | * | 4/2009 | Bosterling et al. | 238/349 |
| 2009/0308943 A1 | * | 12/2009 | Wirthwein et al. | 238/310 |
| 2010/0308123 A1 | | 12/2010 | Bosterling | |
| 2012/0111959 A1 | | 5/2012 | Krieg | |

FOREIGN PATENT DOCUMENTS

DE 102007046543 A1 4/2009

* cited by examiner

*Primary Examiner* — Zachary Kuhfuss
(74) *Attorney, Agent, or Firm* — The Webb Law Firm

(57) ABSTRACT

The present invention relates to a rail clamp for attaching a rail S comprising a central portion 3, at least one torsional portion 9, 10 branching off laterally from the central portion 3, at least one transitional portion 7, 8 adjoining the torsional portion 9, 10 and at least one retaining arm 13, 14 which is connected to the transitional portion 7, 8 and on the free end of which an end portion 19, 20 is configured, by which the rail clamp is supported on the foot F of the rail S to be attached in each case during use, and relates to a system provided with a rail clamp of this type. The rail clamp and the system according to the invention are able, with a high endurance strength, to apply significant hold-down forces and at the same time to ensure that even during progressive wear of the rail attachment, adequately high hold-down forces continue to act on the rail. This is achieved according to the invention in that the retaining arm 13, 14 is continuously curved at least in a curve portion which extends up to the free end of its end portion 19, 20 such that, seen in a plan view of the rail clamp 1, the end portion 19, 20 is directed towards the central portion 3 and the longitudinal axis of the torsional portion 9, 10 associated with the respective retaining arm 13, 14.

11 Claims, 4 Drawing Sheets

RAIL CLAMP FOR ATTACHING A RAIL AND SYSTEM PROVIDED WITH A RAIL CLAMP OF THIS TYPE

The invention relates to a rail clamp for attaching a rail, said clamp comprising a central portion, at least one torsional portion branching off laterally from the central portion, at least one transitional portion adjoining the torsional portion and at least one retaining arm which is connected to the transitional portion and on the free end of which an end portion is configured by which the rail clamp is supported on the foot of the rail to be attached in each case during use. Rail clamps of this type are usually curved in one piece out of spring steel.

The invention also relates to a system for attaching a rail which has a rail foot, a stem positioned thereon and a rail head, the system comprising a guide plate, a rail clamp held on the guide plate and a tensioning means for bracing the rail clamp against a base which supports the rail.

Rail systems and rail clamps of the type mentioned above are described, for example in U.S. Pat. No. 3,690,551 A or in U.S. Pat. No. 3,439,874 A. Seen in a plan view, the retaining arms of the ω-shaped rail clamps known from these patents have a curved path with end portions, the end faces of which are directed towards one another. In this respect, the end portions themselves can be curved or straight, parallel to the respectively associated torsional portion of the rail clamp.

In the final assembly position, the free ends of the retaining arms rest on the foot of the rail to be attached. The central portion of the rail clamp loops around the shaft of the fastening screw. After the rail has been positioned, the rail clamp is moved towards the rail foot and is pressed into the final assembly position by screwing in the screw. This pressing-down action is accompanied by a bracing of the rail clamp producing the retaining force which is required for holding the rail and is resiliently transmitted by the retaining arms onto the rail foot.

A further rail clamp and system of the type stated at the outset are known from DE 10 2007 046 543 A1. In the known system, a rail clamp is used as a resilient element to generate the resilient retaining force required for holding down the rail and which, bearing in mind the length of the supporting plate measured in the longitudinal direction of the rail to be attached, is configured such that at least one of its retaining arms can cover maximum spring deflections. The end portion of the retaining arm is angled off to point away from the torsional portion such that in the assembly position, it is directed towards the stem of the rail to be attached. Due to this measure, on the one hand the narrowly defined supporting region which is configured on the free tip of the respective end portion in which the retaining arm exerts the necessary hold-down force on the foot of the rail by its end portion during use is displaced from the edge of the rail foot in the direction of the stem of the rail to be attached. This ensures that the necessary retaining force is always transmitted efficiently from the respective retaining arm to the rail foot even when, as a result of the transverse forces arising when a rail vehicle travels over the rail and as a result of a possibly imprecise lateral support on the supporting plate, the rail foot moves to an excessive extent transverse to its longitudinal direction.

Furthermore, the displacement of the supporting region in the direction of the rail stem produces a higher resistance to an undesirable twisting action, thereby facilitating in particular the positionally correct assembly of the rail clamp.

Practical experience using the system mentioned above shows that the angled shaping of the end portions of the retaining arms of the rail clamp ensures a secure retention of the rail even in the event of a relatively great transverse displacement. Admittedly, the specific shaping of the rail clamp used in the known system described above proves to be advantageous in respect of a maximum resilience of the spring. However, there is a demand for rail clamps which are not only capable of applying substantial hold-down forces, but which also have an optimised endurance limit. Such requirements exist for example in the case of railway tracks on which extremely heavy transportation trains travel in a high number of cycles.

Against the background of the prior art described above, the object of the invention was to provide a rail clamp and a system for attaching a rail which, with a high endurance limit, are capable of applying high hold-down forces and which also ensure at the same time that adequately high hold-down forces continue to act on the rail even during progressive wear of the rail attachment means.

With regard to a rail clamp, this object is achieved according to the invention in that such a rail clamp has the features stated in claim 1.

With regard to a system for attaching a rail, the object is achieved according to the invention in that such a system comprises a rail clamp which is configured according to the invention.

Advantageous configurations of the invention are set out in the dependent claims and will be described in detail in the following, as will the general inventive concept.

In accordance with the prior art described at the outset, a rail clamp according to the invention for attaching a rail comprises a central portion, at least one torsional portion branching off laterally from the central portion, at least one transitional portion adjoining the torsional portion and at least one retaining arm connected to the transitional portion. Configured on the free end of the respective retaining arm is an end portion by which the rail clamp is supported on the foot of the rail to be attached in each case during use.

According to the invention, the retaining arm of the rail clamp is continuously curved at least in a curve portion extending up to the free end of its end portion such that, seen in a plan view of the rail clamp, the end portion is directed towards the central portion and the longitudinal axis of the torsional portion associated with the respective retaining arm.

Thus, in the case of a rail clamp according to the invention, the end portion which is present on the respective retaining arm is curved in the installation position, being directed away from the stem of the rail to be attached towards the longitudinal axis of the torsional portion, associated with the respective retaining arm, of the rail clamp. In this respect, the curvature of the curved portion with the end portion of the retaining arm is preferably not restricted to only a curvature in one plane. Instead, the curvature is advantageously configured in three spatial directions. In this manner, it is possible to configure on the respective end portion a narrowly defined, approximately punctiform support surface, by which the end portion is supported on the foot of the rail to be attached during use.

Thus, in a rail clamp according to the invention, the preferably narrowly defined support surface which is in the region of the end portion curved according to the invention and by which a rail clamp according to the invention is supported on the surface of the rail foot during use, is displaced in a location which is at a distance measured transversely to the longitudinal extent of the rail from the torsional portion associated with the respective retaining arm, which distance, when seen in a plan view from above of the rail clamp, is shorter than the greatest distance also measured transversely to the longitudinal extent of the rail. Consequently, the retaining arm, curved up to its free end, of a rail clamp according to the invention has an overall increased length compared to conventional rail clamps due to its curvature, projecting with respect to the support surface in the direction of the stem of the rail to be attached, from the torsional portion up to the support surface of its end portion during use. Due to this increased length and to the curved shape, the retaining arms are able to absorb high alternating loads without the risk of being damaged. Thus, with a rail clamp according to the invention, it is possible for high hold-down forces to be applied with optimised endurance strength of the rail clamp.

An equally positive effect is achieved with the configuration according to the invention of a rail clamp when, as a result of wear, the rail is displaced transversely to its longitudinal extent and relative to the guide plate on which the rail clamp is supported. The curved shape, provided by the invention, of the curved portion of the retaining arm leading to the end portion, and of the end portion itself which, in the position of use is directed away from the stem of the rail to be attached, ensures that there is a secure contact between the rail foot and the rail clamp and adequate hold-down forces act on the rail foot even when a gap has formed between the guide plate and the rail foot due to wear, which gap is so large that the end portion acting on the rail foot projects over this gap over part of its length. In this case, although the rail clamp no longer presses on the rail foot with the support surface, loaded in the new condition, of the respective end portion, the shape of the end portion which is curved in the direction of the torsional portion of the rail clamp or of its imaginary extension or longitudinal axis ensures that the rail clamp still acts securely on the rail even in this situation. Thus, the rail clamp "rolls" with its curved end portion on the rail foot when the rail is displaced, with the result that according to the displacement of the rail due to wear, the support surface by which the end portion acts on the rail is also displaced. This effect occurs in particular when the end portion is curved in three spatial directions, i.e. when it sits on the rail foot only by a narrowly defined, approximately punctiform support surface during use.

Due to the shape, guided in a comparatively wide curve, of its curved portion, the retaining arm of a rail clamp according to the invention has an increased length. This results in a stronger resilience of the retaining arm and thus in a lower load, and thereby its endurance strength is increased. In this respect, the shortest distance between the end portion configured according to the invention and the associated torsional portion can be used as an indication of the minimum length of the retaining arm. In the new state of a ready assembled system according to the invention, this distance should be greater than the shortest distance between the torsional portion and the edge of the rail foot associated with a contact surface of the guide plate. In this manner, it is ensured that even when there is an imprecise alignment of rail foot and guide plate which occurs as a result of wear or assembly errors, the end portion always sits on the rail foot over a sufficient length in order to apply the necessary hold-down force.

The advantages, summarised above, of an alignment and shaping of the end portion of a rail clamp according to the invention are particularly evident when the length of the curved end portion of the retaining arm corresponds to at least 20% of the length of the torsional portion.

According to a variant of the retaining arm according to the invention, only the end-face curved portion which comprises the respective end portion is continuously curved, while the retaining arm is straight in at least one other portion in order to bridge great distances, for example.

According to another variant, since the entire retaining arm is configured as a continuously curved portion, stresses acting in the retaining arm can be reduced so that a maximum endurance strength is achieved. At the same time, with this shaping, it is easy to produce the rail clamp.

The retaining arm can be formed such that during the course of bracing, it is only deformed minimally. This makes it possible to align the end portion of the retaining arm from the start with respect to its remaining part such that it is already sitting on the surface of the rail foot when the rail clamp is relaxed. For this purpose, the shaping and alignment of the retaining arm is selected such that the retaining arm as far as possible acts exclusively as a lever with a low inherent resilience, so that the spring force exerted by the rail clamp in the braced state is substantially only generated by torsion of the torsional portion. This can be achieved in that the retaining arm is aligned relative to the torsional portion such that the torsional portion and the retaining arm, seen in a plan view from above of the rail clamp, include an angle of 80° to 110°, in particular 85° to 95°, where an included angle approximating 90° within manufacturing possibilities provides optimum results.

The rigidity of the retaining arm can be optimised in that a curved part of the retaining arm runs in a plane through which the torsional portion passes at an angle of 80° to 100°. In practice, this orientation of the curved part of the retaining arm can be realised in that the transitional portion between the retaining arm and the torsional portion describes a curve which is directed upwards when the rail clamp is on a horizontal surface and includes an angular region of 80° to 110°. When the respective part of the retaining arm of a rail clamp according to the invention is curved, the retaining arm is curved or dome-shaped in the region of this part in a side view, which ensures that the shape of the retaining arm remains substantially unchanged even under high resilient hold-down forces or if the rail is displaced transversely. Consequently, in the braced state, its end portion is also always in an optimum position on the rail foot.

The concentration of the generation of the hold-down force on the torsional portion can be further promoted in that, seen in a plan view, the central portion includes with the torsional portion an angle of 80° to 110°. In this configuration, the central portion also acts substantially exclusively as a lever for the torsion of the torsional portion, without itself being resiliently flexible.

Rail clamps according to the invention, like the rail clamps known from the prior art, can be produced in one piece from a spring steel wire by forming a continuously curved line.

The storage and handling of a rail clamp according to the invention can be simplified in a manner known per se in that the spacing between the free end of the curved end portion and the central portion is smaller than the smallest thickness of the central portion, the torsional portion, the transitional portion, the retaining arm and the end portion. This measure reliably prevents loosely stored rail clamps from becoming entangled in one another. Of course, it is possible for a rail clamp according to the invention to be configured mirror-symmetrically like the known rail clamps in that the central portion is shaped in the manner of a loop with two opposed torsional portions branching off therefrom, to which a respective retaining arm with a curved end portion is connected by a respective transitional portion. The rail clamp according to the invention is then W-shaped or ω-shaped.

The concentration, strived for according to the invention, of the generation of the resilient hold-down force on the torsional portion allows a particularly space-saving configuration of a rail clamp according to the invention. For this, according to an advantageous embodiment of the invention, the length of the torsional arm is calculated in each case to be short enough for at least portions of the respective retaining arm to be guided above the guide plate.

In the following, the invention will be described in more detail with reference to schematic drawings illustrating an exemplary embodiment.

Figure 4:
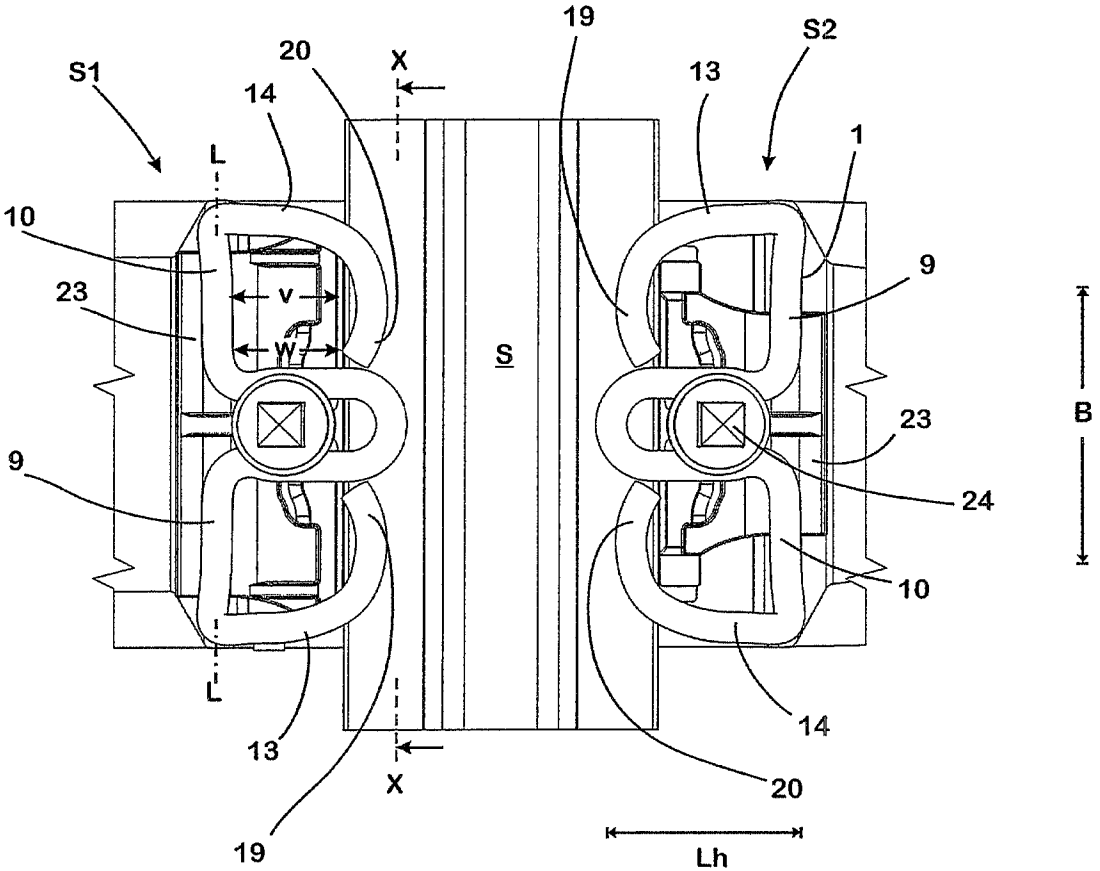
FIG. 4 is a plan view of an attachment point formed by two systems for attaching a rail.
Figure 5:
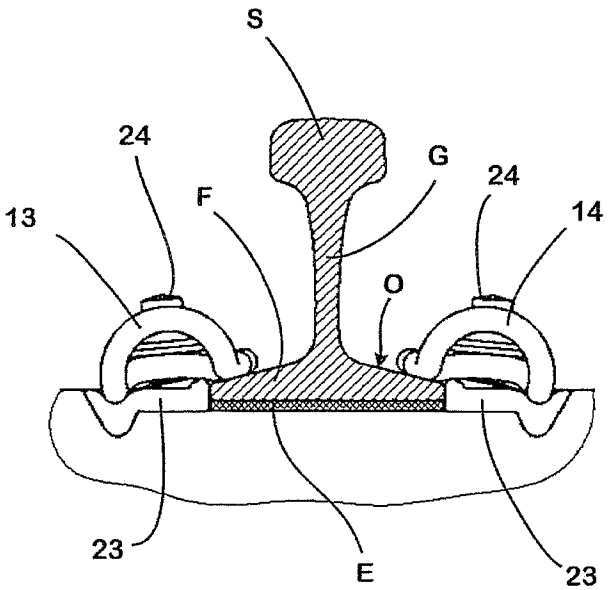
FIG. 5 is a lateral, partially sectional view of the attachment point according to FIG. 4.

The rail clamp 1 formed in one piece from a spring steel wire in a continuously curved line for attaching a rail S supported on a base U which is formed here, for example, by a concrete sleeper is configured mirror-symmetrically relative to a plane N1 aligned normal to the contact surface of the base U. It has a loop-type central portion 3 which is U-shaped in a plan view (FIG. 4), with two mutually parallel, spaced apart limbs 4, 5 and a semicircular connecting portion 6 which joins the limbs 4, 5 together and is associated with the foot F of the rail S to be attached.

A respective torsional portion 9, 10 which branches off laterally is connected to each limb 4, 5 of the central portion 3 by a respective transitional portion 7, 8 which is curved by 90°. In this respect, the torsional portions 9, 10 are directed in opposing directions away from the central portion 3 and, seen in a plan view, include with the limbs 4, 5, respectively associated therewith, of the central portion a respective angle $\alpha$ of approximately 90°.

Figure 1:
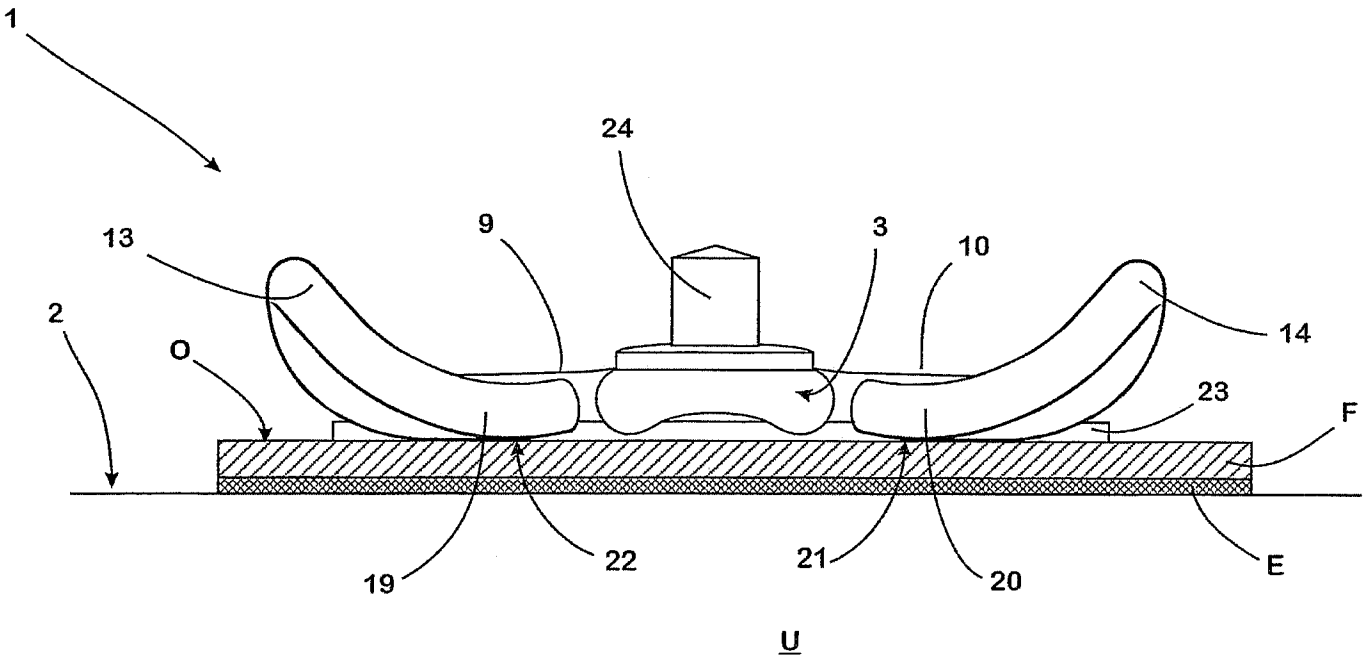
FIG. 1 shows the attachment point, shown in FIG. 4, along the sectional line X-X marked in FIG. 4.
Figure 2:
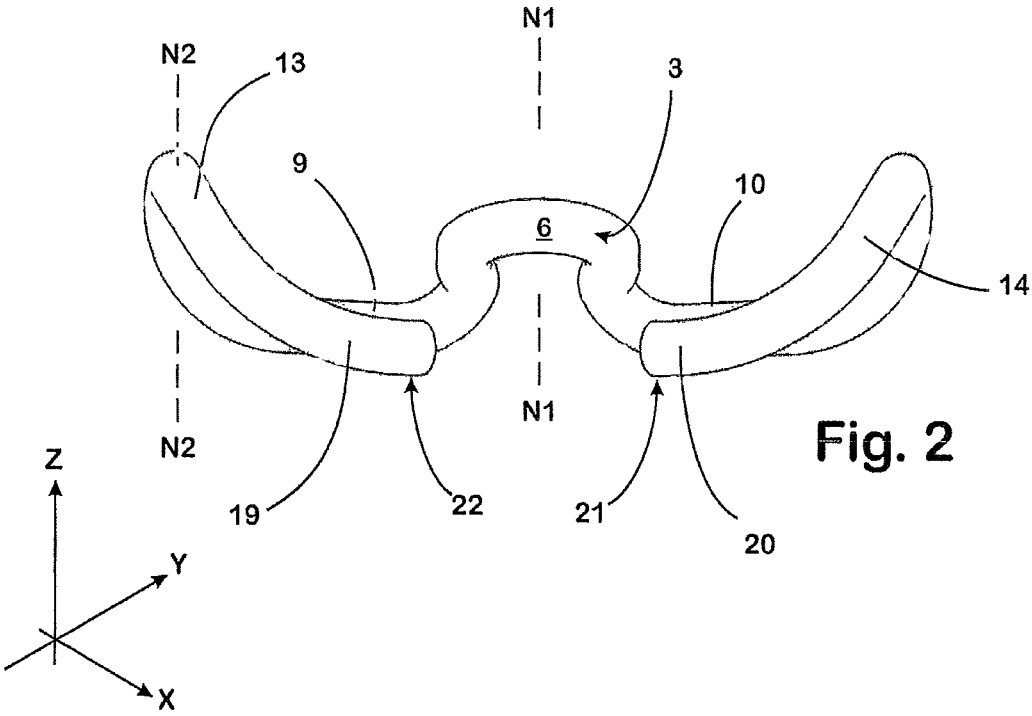
FIG. 2 is a front view of a rail clamp used in the system shown in FIGS. 4 and 5.

Connected to the ends, remote from the central portion 3, of the torsional portions 9, 10 is a respective further transitional portion 11, 12 which leads upwards in a circular arch which includes an angle of approximately 90° when the rail clamp 1 is positioned on its lower side (FIG. 1, 2).

Each of the transitional portions 11, 12 merges into a continuously curved retaining arm 13, 14 at its end remote from the respective torsional portion 9, 10. Due to the shape which is curved continuously in the three spatial directions X, Y, Z, the retaining arms 13, 14 as such are in each case an individual portion of a curve. Seen in a plan view, the parts 15, 16 of the retaining arms connected to the respective transitional portion 11, 12 include in each case with the associated torsional portion 9, 10 an angle $\beta$ of approximately 90°, so that, seen in a plan view, they are aligned substantially parallel to the limbs 4, 5 of the central portion 3.

Accordingly, the centre axis M of the respective part 15, 16 of the retaining arms 13, 14 runs in a plane N2 through which the common longitudinal axis L passes of the torsional portions 9, 10 in each case at an angle of approximately 90°+/−5°. In this respect, the parts 15, 16 of the retaining arms 13, 14 are curved in the manner of a cupola strut and encompass an angular region of approximately 180°.

Figure 3:
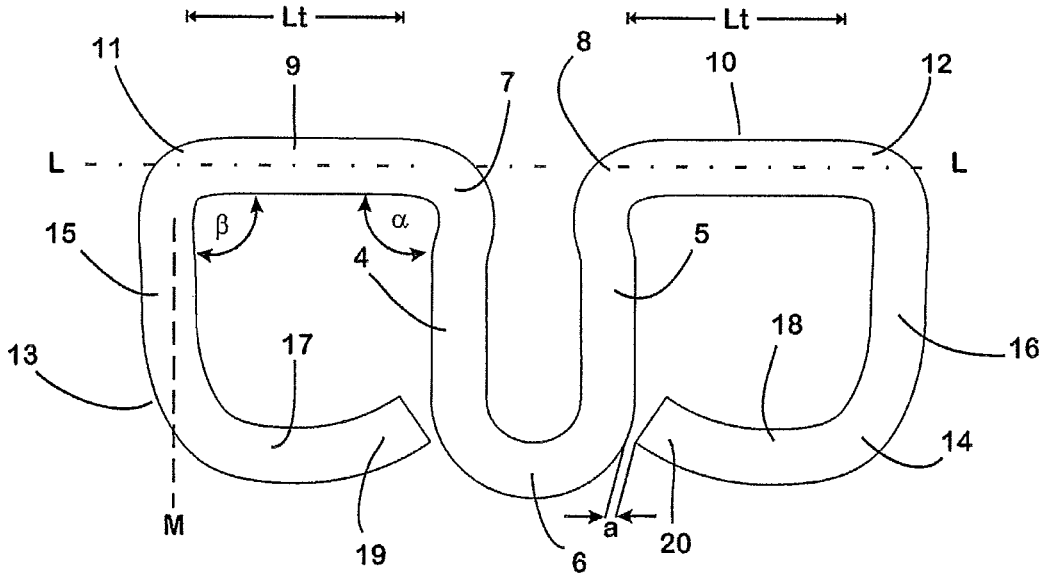
FIG. 3 is a plan view from above of the rail clamp according to FIG. 2.

At their end remote from the respective torsional portion 9, 10, the parts 15, 16 of the retaining arms 13, 14 merge in a respective transitional portion 17, 18 leading downwards by approximately 90° towards the central portion 3 into a respective end portion 19, 20. Seen in a plan view (FIG. 3), these end portions 19, 20 are both curved in the three spatial directions X, Y, Z as a continuation of the transitional portions 17, 18 further in the direction of the longitudinal axis L of the torsional portions 9, 10 and in the direction of the central portion 3 such that when they are positioned on a planar surface, they are both supported on the respective surface by a narrowly defined, approximately punctiform support surface 21, 22. Bearing in mind the length of the parts 15, 16 of the retaining arms 14, 14 which extend substantially parallel to the limbs 4, 5 of the central portion 3, the length and curvature of the end portions 19, 20 is selected in each case such that the end portions 19, 20 terminate in a spacing a to the connecting portion 6 of the central portion 3, which spacing a is smaller than the smallest thickness d of the spring steel, from which the rail clamp 1 is curved. The clearance of the spacing between the central portion 3 and the end portions 19, 20 is consequently so small that no other rail clamp 1 can pass through this spacing.

To attach the rail S to the base U, two identically configured systems S1, S2 are used which are assembled on opposite sides of the rail S and each comprise a rail clamp 1, a guide plate 23 and a tensioning screw 24 required as a means for tensioning the rail clamp 1.

In the exemplary embodiment described here, the guide plate 23 is configured as a type of conventional angular guide plate and has on its lower side associated with the base U a shoulder which extends over its width B measured in the longitudinal direction of the rail S and which sits in a correspondingly formed groove provided in the base U when the guide plate 23 is in the assembly position.

Furthermore, in the assembly position, the guide plate 23 is supported in each case by its back remote from the rail S on a shoulder which is also configured on the base U. The guide plate 23 has a respective contact surface against which the rail foot F is supported by its longitudinal edge, on the front of the guide plate 23 which is widened relative to the back and is associated with the rail foot F. Transverse forces which arise from the rail S when a rail vehicle (not shown here) travels over the rail are thus absorbed by the guide plate 23 and diverted into the base U.

Adjacent to its back, the guide plate 23 has on its upper side a respective groove which extends parallel to the contact surface of the guide plate 23 as well as additional moulded elements, not shown here in detail, for guiding the rail clamp 1 mounted in each case on the guide plate 23 and a through-hole, not visible here either, which leads from the upper side to the base U and through which the tensioning screw 24 is inserted. The tensioning screw 24 is screwed in each case into a dowel (not visible here) which is introduced into the base U.

The rail clamp 1 arranged on the respective guide plate 23 sits with its torsional portions 9, 10 in the groove in the guide plate 23. The length Lt of the torsional portions 9, 10 is calculated in each case such that the retaining arms 13, 14 are each guided above the guide plate 23 and at least over the widened front region of the guide plate associated with the rail foot F. Thus, the width respectively occupied by the rail clamp 1 is only marginally greater than the width B of the guide plates 23.

At the same time, the length of the limbs 4, 5 of the central portion 3 is calculated such that when the tensioning screw has been screwed in but not fully tightened, the rail clamp 1 can sit in a pre-assembly position in which its torsional portions 9, 10 are arranged offset in the direction of the back of the guide plate 23 to such an extent outside the groove, associated therewith, in the guide plate 23 that the curved end portions 19, 20 of the rail clamp 1 no longer project into the region provided for the rail S. After the rail S has been positioned in the space provided for it between the guide plates 23 of the systems S1, S2, the rail clamps 1 can then be pushed out of their pre-assembly position into the final assembly position in which they rest on the upper side o of the rail foot F with their end portions 19, 20 which are curved away from the stem G of the rail S. The respective tensioning screw 24 is then tightened. In so doing, the central portion 3 of the rail clamps 1 is moved in each case in the direction of the base U. Since the retaining arms 13, 14 are simultaneously supported in a substantially rigid manner on the rail foot F, when the rail clamps 1 are braced, only the torsional portions 9, 10 thereof are substantially twisted. As a result, high resilient forces are provided for resiliently holding down the rail S. These resilient forces are applied onto the rail foot F over a comparably large contact surface, so that in spite of the increased hold-down forces, the risk of an abrasive wear is minimised in the contact region between the rail clamp 1 and the rail foot F. In order to ensure the necessary compliance of the support of the rail S also in the direction of the base U, a resilient layer E can be provided in a manner known per se between the rail foot F and the base.

The length Lh, measured transversely to the longitudinal extent of the rail S and to the longitudinal axis L, of the retaining arms 13, 14 is calculated such that in a new condition with a ready assembled system S1, S2, the shortest distance w between the respective torsional portion 9, 10 which runs axially parallel to the longitudinal axis L and the respectively associated end portion 19, 20 is greater than the distance v between the edge of the rail foot F associated with the respective guide plate 23 and the respective torsional portion 9, 10. This configuration of the retaining arms 13, 14 ensures that the end portions 19, 20 are always reliably supported on the rail foot F. If, due to wear, the rail S is displaced relative to the guide plate 23, as a result of which the originally loaded support surfaces 21, 22 of the end portions project into a gap which forms between the guide plate 23 and the rail foot F, the end portions 19, 20 nevertheless continue to rest on the rail foot F via support portions which are at a corresponding distance from the free end face of the end portions 19, 20.

LIST OF REFERENCE NUMERALS

1 rail clamp
2 contact surface of base U
3 central portion of respective rail clamp 1
4, 5 limbs of respective rail clamp 1
6 connecting portion of central portion 3
7, 8 transitional portions of respective rail clamp 1
9, 10 torsional portions of respective rail clamp 1
11, 12 transitional portions of respective rail clamp 1
13, 14 retaining arms of respective rail clamp 1
15, 16 parts of the retaining arms of respective rail clamp 1
17, 18 transitional portions of respective rail clamp 1
19, 20 end portions of respective rail clamp 1
21, 22 support surface of respective rail clamp 1
23 guide plates
24 tensioning screws
a spacing
B width of guide plates 23
d thickness of spring steel of respective rail clamp 1
E resilient layer
F foot of rail S
G stem of rail S
L longitudinal axis of torsional portions 9, 10
Le length of end portions 19, 20
Lt length of torsional portions 9, 10
Lh length of retaining arms 13, 14
M centre axis of parts 15, 16
N1 plane
N2 plane
O upper side of rail foot F
S rail
S1, S2 systems for attaching a rail S
U base
w shortest distance between torsional arms 9, 10 of rail clamp 1 and the end of end portion 19, 20 associated therewith in each case
v distance between torsional arms 9, 10 of rail clamp 50 and the edge of the rail foot F associated therewith in each case
$\alpha$ angle
$\beta$ angle
X, Y, Z spatial directions

The invention claimed is:

1. A rail clamp for attaching a rail comprising a central portion, at least one torsional portion branching off laterally from the central portion, at least one transitional portion adjoining the torsional portion and at least one retaining arm which is connected to the transitional portion, the retaining arm having an end portion configured for supporting the rail clamp on the a foot of the rail during use, wherein a terminal end of the end portion vertically overlies the foot of the rail during use, and wherein the retaining arm is continuously curved at least in a curve portion which extends up to the terminal end of an end portion such that, seen in a plan view of the rail clamp, the end portion is directed towards (a) the central portion and (b) a longitudinal axis of the torsional portion associated with the respective retaining arm.

2. The rail clamp according to claim 1, wherein the curved portion of the retaining arm and the end portion is curved in three spatial directions.

3. The rail clamp according to claim 1, wherein the retaining arm and the torsional portion include an angle of 80° to 110° , seen in a plan view.

4. The rail clamp according to claim 3, wherein the angle included by the retaining arm and the torsional portion, seen in a plan view, is 85° to 95° .

5. The rail clamp according to claim 1, wherein a curved part of the retaining arm extends in a plane through which the torsional portion passes at an angle of 80° to 100° formed at the transitional portion between the retaining arm and the torsional portion.

6. The rail clamp according to claim 1, wherein, seen in a plan view, the central portion includes an angle of 80° to 110° with the torsional portion.

7. The rail clamp according to claim 1, wherein the retaining arm forms a continuously curved line.

8. The rail clamp according to claim 1, wherein a spacing between the terminal end of the end portion and the central portion is smaller than a smallest thickness of the central portion, the torsional portion, the transitional portion, the retaining arm and the end portion.

9. The rail clamp according to claim 1, wherein the rail clamp is configured mirror-symmetrically in that the central portion is in the form of a loop and two mutually oppositely aligned torsional portions branch off therefrom and connected to said torsional portions via a respective transitional portion is a respective retaining arm with a respective end portion.

10. A system for attaching a rail which has a rail foot, a stem positioned thereon and a rail head, the system comprising a guide plate, a rail clamp held on the guide plate and a tensioning means for bracing the rail clamp against a base supporting the rail, wherein the rail clamp is configured according to claim 1, and wherein the shortest distance between the torsional portion and the end portion associated therewith is greater than the shortest distance between the torsional portion and the edge of the rail foot associated with a contact surface of the guide plate.

11. The system according to claim 10, wherein a length of the torsional portion is calculated such that, when assembled, at least portions of the respective retaining arm are guided above the guide plate.

* * * * *

UNITED STATES PATENT AND TRADEMARK OFFICE

CERTIFICATE OF CORRECTION

PATENT NO. : 8,844,836 B2
APPLICATION NO. : 12/939831
DATED : September 30, 2014
INVENTOR(S) : Nikolaj Krieg It is certified that error appears in the above-identified patent and that said Letters Patent is hereby corrected as shown below:

In the Claims,

Column 8, Line 19, Claim 1, delete “the a” and insert -- a --

Column 8, Line 32, Claim 3, delete “110° ,” and insert -- 110°, --

Column 8, Line 35, Claim 4, delete “95° .” and insert -- 95°. --

Signed and Sealed this
Twenty-seventh Day of January, 2015

Michelle K. Lee

Michelle K. Lee
*Deputy Director of the United States Patent and Trademark Office*